US010724112B2

(12) United States Patent
Kura et al.

(10) Patent No.: US 10,724,112 B2
(45) Date of Patent: Jul. 28, 2020

(54) FENI ORDERED ALLOY AND METHOD FOR MANUFACTURING FENI ORDERED ALLOY

(71) Applicant: DENSO CORPORATION, Kariya, Aichi-pref. (JP)

(72) Inventors: Hiroaki Kura, Kariya (JP); Sho Goto, Kariya (JP); Yasushi Hayashi, Kariya (JP)

(73) Assignee: DENSO CORPORATION, Kariya (JP)

( * ) Notice: Subject to any disclaimer, the term of this patent is extended or adjusted under 35 U.S.C. 154(b) by 200 days.

(21) Appl. No.: 15/760,748

(22) PCT Filed: Sep. 23, 2016

(86) PCT No.: PCT/JP2016/078026
§ 371 (c)(1),
(2) Date: Mar. 16, 2018

(87) PCT Pub. No.: WO2017/064989
PCT Pub. Date: Apr. 20, 2017

(65) Prior Publication Data

US 2018/0251867 A1 Sep. 6, 2018

(30) Foreign Application Priority Data

Oct. 14, 2015 (JP) ..... 2015-203067
Aug. 12, 2016 (JP) ..... 2016-159001

(51) Int. Cl.
*C21D 3/08* (2006.01)
*C23C 8/26* (2006.01)
(Continued)

(52) U.S. Cl.
CPC ..... *C21D 3/08* (2013.01); *B22F 1/0018* (2013.01); *B22F 1/0088* (2013.01);
(Continued)

(58) Field of Classification Search
CPC ..... C21D 3/08; B22F 1/0088; B22F 1/0018; C22C 19/03; C23C 8/80; C23C 8/26
See application file for complete search history.

(56) References Cited

U.S. PATENT DOCUMENTS

2004/0033357 A1 2/2004 Hattori et al.
2004/0261905 A1 12/2004 Hattori et al.
(Continued)

FOREIGN PATENT DOCUMENTS

JP 2014-105376 A 6/2014
JP 2014-231624 A 12/2014
(Continued)

OTHER PUBLICATIONS

Kojima et al. (2014). Fe—Ni composition dependence of magnetic anisotropy in artificially fabricated L10-ordered FeNi films. Journal of Physics: Condensed Matter, vol. 26, (2014), 064207, pp. 1-10. (Discussed on p. 2 of the specification.).
(Continued)

*Primary Examiner* — Jessee R Roe
(74) *Attorney, Agent, or Firm* — Posz Law Group, PLC

(57) ABSTRACT

A method for manufacturing FeNi ordered alloy having a $L1_0$ type order structure is provided. After a nitrification process for nitriding a powder sample of a FeNi disordered alloy arranged in a tube furnace is performed using a $NH_3$ gas, a de-nitrification process for removing a nitrogen from the FeNi disordered alloy which is processed by the nitrification process is performed using a $H_2$ gas. Thus, the $L1_0$ type FeNi ordered alloy with a regularity defined by S equal to or higher than 0.5 is obtained.

7 Claims, 13 Drawing Sheets

(51) Int. Cl.

| | |
|---|---|
| ***C23C 8/80*** | (2006.01) |
| ***C22C 19/03*** | (2006.01) |
| ***C22C 1/04*** | (2006.01) |
| ***H01F 1/06*** | (2006.01) |
| ***B22F 1/00*** | (2006.01) |
| ***C22C 30/00*** | (2006.01) |
| ***C22C 38/08*** | (2006.01) |
| *C22C 33/02* | (2006.01) |

(52) U.S. Cl.

CPC ..... *C22C 1/0491* (2013.01); *C22C 19/03* (2013.01); *C22C 30/00* (2013.01); *C22C 38/08* (2013.01); *C23C 8/26* (2013.01); *C23C 8/80* (2013.01); *H01F 1/068* (2013.01); *B22F 2998/10* (2013.01); *B22F 2999/00* (2013.01); *C22C 1/0433* (2013.01); *C22C 33/0285* (2013.01)

(56) References Cited

U.S. PATENT DOCUMENTS

| | | | |
|---|---|---|---|
| 2004/0261906 | A1 | 12/2004 | Hattori et al. |
| 2004/0261907 | A1 | 12/2004 | Hattori et al. |

FOREIGN PATENT DOCUMENTS

| | | | |
|---|---|---|---|
| JP | 5892662 | B2 | 3/2016 |
| WO | 2012/141205 | A2 | 10/2012 |
| WO | 2016/171232 | A1 | 10/2016 |

OTHER PUBLICATIONS

Hayashi et al. (2015). Synthetic Technique Dependency in Crystal Structure of FeNi Alloy Particle. SPring-8 Section B: Industrial Application Report. May 7, 2015; Early edition: Jun. 22, 2015: Accepted: Jun. 29, 2015; (published: Jul. 21, 2015). (English translation attached).

FIG. 3

| | DISORDERED ALLOY MANUFACTURING METHOD | COMPOSITION RATIO (Fe:Ni) | VOLUME AVARAGE DIAMETER [nm] | NITRIFICATION PROCESS CONDITIONS (TEMPERATURE [°C] / TIME [HOUR]) | DE-NITRIFICATION PROCESS CONDITIONS (TEMPERATURE [°C] / TIME [HOUR]) | $L1_0$ FORMATION |
|---|---|---|---|---|---|---|
| COMPARISON EXAMPLE S0 | THERMAL PRASMA | 50:50 | 104 | —/— | —/— | NO |
| COMPARISON EXAMPLE S1 | THERMAL PRASMA | 50:50 | 104 | 300/4 | —/— | NO |
| COMPARISON EXAMPLE S2 | THERMAL PRASMA | 50:50 | 104 | —/— | 300/4 | NO |
| EMBODIMENT EXAMPLE S3 | THERMAL PRASMA | 50:50 | 104 | 300/4 | 300/4 | YES |
| EMBODIMENT EXAMPLE S4 | FRAME SPRAY | 55:45 | 50 | 300/4 | 300/4 | YES |
| EMBODIMENT EXAMPLE S5 | COPRECIPITATION | 47:53 | 200 | 300/4 | 300/4 | YES |
| EMBODIMENT EXAMPLE S6 | THERMAL PRASMA | 50:50 | 104 | 325/4 | 300/4 | YES |
| EMBODIMENT EXAMPLE S7 | THERMAL PRASMA | 50:50 | 104 | 350/4 | 300/4 | YES |
| EMBODIMENT EXAMPLE S8 | THERMAL PRASMA | 50:50 | 104 | 400/4 | 300/4 | YES |
| EMBODIMENT EXAMPLE S9 | THERMAL PRASMA | 50:50 | 104 | 500/4 | 300/4 | YES |
| COMPARISON EXAMPLE S10 | THERMAL PRASMA | 50:50 | 104 | 325/4 | 150/4 | NO |
| COMPARISON EXAMPLE S11 | THERMAL PRASMA | 50:50 | 104 | 325/4 | 200/4 | YES |
| EMBODIMENT EXAMPLE S12 | THERMAL PRASMA | 50:50 | 104 | 325/4 | 250/4 | YES |
| EMBODIMENT EXAMPLE S13 | THERMAL PRASMA | 50:50 | 104 | 325/4 | 350/4 | YES |
| EMBODIMENT EXAMPLE S14 | THERMAL PRASMA | 50:50 | 104 | 325/4 | 400/4 | YES |
| COMPARISON EXAMPLE S15 | THERMAL PRASMA | 50:50 | 104 | 325/4 | 450/4 | NO |
| COMPARISON EXAMPLE S16 | THERMAL PRASMA | 50:50 | 104 | 325/4 | 500/4 | NO |

FENI ORDERED ALLOY AND METHOD FOR MANUFACTURING FENI ORDERED ALLOY

CROSS REFERENCE TO RELATED APPLICATIONS

This application is a U.S. national stage application of International Application No. PCT/JP2016/078026 filed on Sep. 23, 2016 and is based on Japanese Patent Applications No. 2015-203067 filed on Oct. 14, 2015, and No. 2016-159001 filed on Aug. 12, 2016, the disclosures of which are incorporated herein by reference.

TECHNICAL FIELD

The present disclosure relates to $L1_0$ type FeNi ordered alloy having $L1_0$ type ordered structure, a method for manufacturing $L1_0$ type FeNi ordered alloy, and further, magnetic material made of $L1_0$ type FeNi ordered alloy. Specifically, the present disclosure relates to $L1_0$ type FeNi ordered alloy with a regularity equal to or larger than 0.5.

BACKGROUND $L1_0$ type (i.e., L one zero type) FeNi (i.e., iron-nickel) ordered alloy is expected to provide magnet material or magnetic storage material without any rare earth or any noble metal. Here, the $L1_0$ type ordered structure is a crystal structure having a face-centered cubic lattice as a unit cell in which a Fe layer and a Ni layer are arranged in a <001> direction in a layer manner. Such a $L1_0$ type ordered structure is provided by alloy made of FePt, FePd, AuCu or the like. In general, the structure is prepared by heat-treating a disordered alloy at temperature equal to or lower than order-disorder transition temperature Tλ to facilitate diffusion.

However, the transition temperature Tλ, for obtaining the $Ll_0$ type FeNi ordered alloy is 320° C., which is comparatively low temperature. Since the diffusion is extremely slow at the temperature equal to or lower than the transition temperature TX, it is difficult to synthesize only in the heat treatment. Thus, conventionally, various attempts are tried to synthesize the $Ll_0$ type FeNi ordered alloy.

Specifically, conventionally, a method for stacking a single atomic Fe layer and a single atomic Ni layer alternately using a molecular beam epitaxy (i.e., MBE), a method for performing heat treatment in a magnetic field with irradiating a neutron beam, or the like is proposed.

NON-PATENT LITERATURE

Non-Patent Literature 1: Kojima et al., "Fe—Ni composition dependence of magnetic anisotropy in artificially fabricated $L1_0$ ordered FeNi films," J. Phys., Condensed Matter, Vol. 26, (2014), 064207

SUMMARY

We found a difficulty in a conventional method such as the method using the molecular beam epitaxy disclosed in the non-patent literature 1 and the method using a neutron beam irradiation such that it is necessary to execute complicated process and heat treatment with long process time in order to synthesize the $L1_0$ type FeNi ordered alloy.

Further, it is preferable to have the high regularity in view of improvement of a magnet property. The regularity of the $L1_0$ type FeNi ordered alloy obtained by the above conventional method is around 0.4 in maximum, which is comparatively small. Thus, it is necessary to increase the regularity much more.

It is an object of the present disclosure to provide a manufacturing method for synthesizing easily $L1_0$ type FeNi ordered alloy having high regularity equal to or higher than 0.5.

According to a first aspect of the present disclosure, a method for manufacturing FeNi ordered alloy having a $L1_0$ type order structure, the method for manufacturing the FeNi ordered alloy includes: performing a nitrification process for nitride a FeNi disordered alloy; and then, performing a de-nitrification process for removing a nitrogen from the FeNi disordered alloy, which is processed in the nitrification process, to obtain the $L1_0$ type FeNi ordered alloy with a regularity defined by S equal to or higher than 0.5.

The above method for manufacturing FeNi ordered alloy is discovered experimentally according to study of inventors. According to the study, the $L1_0$ type FeNi ordered alloy having the high regularity defined by S equal to or higher than 0.5 is easily synthesized.

According to a second aspect of the present disclosure, FeNi ordered alloy including: a $L1_0$ type order structure; and a regularity defined by S, which is equal to or higher than 0.5, is provided.

The above FeNi ordered alloy is manufactured by the manufacturing method according to the first aspect of the present disclosure. Thus, the $L1_0$ type FeNi ordered alloy having the high regularity defined by S equal to or higher than 0.5 is easily obtained.

Further, a magnetic material including the FeNi ordered alloy having the $L1_0$ type order structure with the regularity defined by S equal to or higher than 0.5 is provided.

The above magnetic material is manufactured using the FeNi ordered alloy according to the second aspect. The magnetic material includes the $L1_0$ type FeNi ordered alloy having the high regularity defined by S equal to or higher than 0.5, and therefore, the magnetic material having excellent magnet property is provided.

According to a third aspect of the present disclosure, a method for manufacturing FeNi ordered alloy having a $L1_0$ type order structure, includes:

synthesizing a compound in which Fe and Ni are aligned to have a lattice structure identical to a $L1_0$ type FeNi order structure; and removing an unnecessary element other than Fe and Ni from the compound to produce a $L1_0$ type FeNi ordered alloy.

Thus, the compound in which Fe and Ni are aligned to have a lattice structure identical to a $L1_0$ type FeNi order structure is synthesized. The $L1_0$ type FeNi ordered alloy is produced based on the compound. According to the manufacturing method, the $L1_0$ type FeNi ordered alloy having the high regularity defined by S equal to or higher than 0.7 is easily synthesized.

BRIEF DESCRIPTION OF DRAWINGS

FIG. 3 is a diagram showing an evaluation results and manufacturing conditions in an embodiment according to a first embodiment and a comparison example.

EMBODIMENTS

Figure 1:
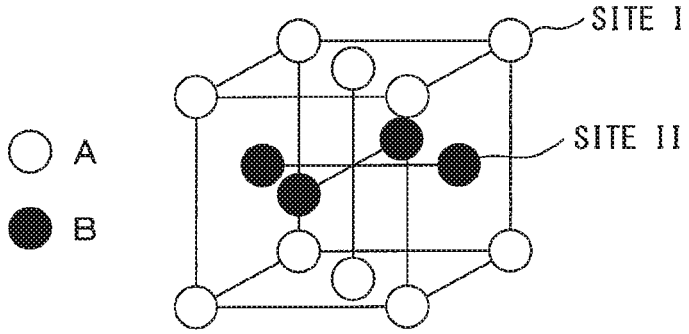
FIG. 1 is a schematic diagram showing a lattice structure of a $L1_0$ type FeNi ordered structure.

Embodiments will be explained with reference to drawings. Here, the same or equivalent element according to each embodiment has the same reference numeral in the explanation.

First Embodiment

A first embodiment will be explained. A $L1_0$ type FeNi ordered alloy, i.e., FeNi super lattice according to the present embodiment is applied to magnetic material such as magnet material or magnetic storage material. The regularity S is equal to or larger than 0.5, and therefore, the magnetic property is excellent.

Here, the regularity S shows the degree of the order in the FeNi super lattice. As described above, the $L1_0$ type ordered structure has a structure with a face-centered cubic lattice as a unit cell. The structure has the lattice structure shown in FIG. 1. In the drawing, an utmost upper layer in a stacking structure on a (001) plane of the face-centered cubic lattice is defined as site I, and a middle layer disposed between the utmost upper layer and an utmost lower layer is defined as site II. In this case, an existing ratio of metal A at site I is defined as x, and an existing ration of metal B at site I is defined as (1−x). The existing ratio of metal A and metal B at site I is expressed as $A_xB_{1-x}$, Similarly, an existing ratio of metal B at site II is defined as x, and an existing ration of metal A at site II is defined as (1−x). The existing ratio of metal A and metal B at site II is expressed as $A_{1-x}B_x$. Here, x satisfies with an equation of $0.5 \leq x \leq 1$. In this case, the regularity S is defined as $S=2x-1$.

Figure 2:
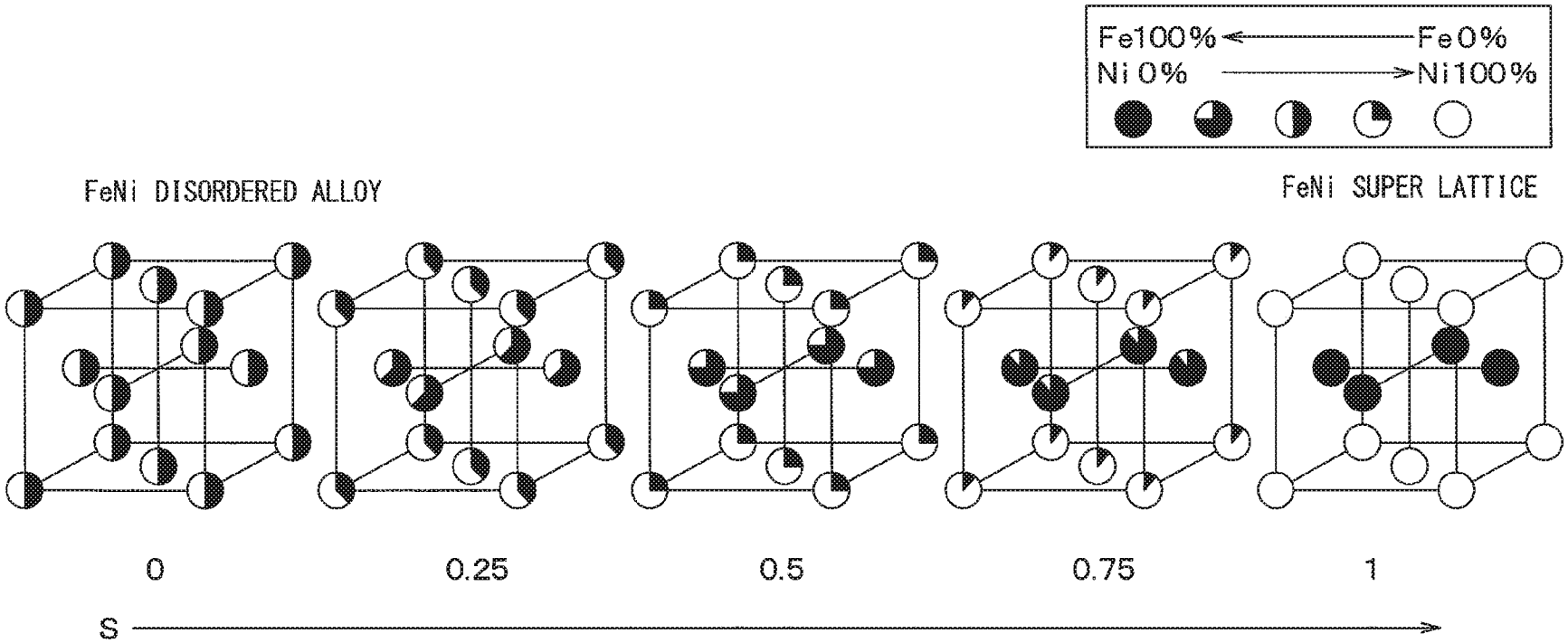
FIG. 2 is a schematic diagram showing appearance of a lattice structure of FeNi alloy at each regularity S between FeNi disordered alloy with the regularity S of zero and FeNi super lattice with the regularity S of 1.0.

Accordingly, for example, when the metal A is Ni, the metal B is Ni, Ni is shown as a white circle, and Fe is shown as a black circle, the regularity S of the FeNi alloy between the FeNi disordered alloy with the regularity S of zero and the FeNi supper lattice with the regularity S of 1 is shown in FIG. 2. Here, a fully white circle represents that Ni is 100%, and Fe is 0%. A fully black circle represents that Ni is 0%, and Fe is 100%. A half white and half black circle represents that Ni is 50%, and Fe is 50%.

Regarding the regularity S defined above, for example, when the site I is mainly occupied by the metal A, i.e., Ni, and the site II is mainly occupied by the metal B, i.e., Fe, and at least an average regularity S as a whole is equal to or larger than 0.5, an excellent magnetic property may be obtained. Here, regarding the regularity S, it is necessary to be high value in average as a whole of material. Thus, even if the value is locally high, the excellent magnetic property may not be obtained. Accordingly, even if the value is locally high, the material does not belong to a case where the average regularity S as a whole is equal to or larger than 0.5.

The $L1_0$ type FeNi ordered alloy is prepared by executing the de-nitrification process for removing nitrogen from the FeNi disordered alloy which is processed by the nitrification process after the nitrification process for nitriding the FeNi disordered alloy is performed. Here, the disordered alloy has no regularity of an atomic arrangement so that the arrangement is random.

The manufacturing method of the $L1_0$ type FeNi ordered alloy according to the present embodiment will be explained in detail with reference to embodiment examples S3, S4, S5, S6, S7, S8, S9, S12, S13 and S13 and the comparison examples S0, S1, S2, S10, S11, S15 and S16 shown in FIG. 3.

The above embodiment examples and comparison examples are prepared by executing the nitrification process and the de-nitrification process of powder samples of the FeNi disordered alloy, which is manufactured by a thermal plasma method, a frame spray method and a co-precipitation method, shown in FIG. 3. The alloy after processed is studied by a X ray diffraction measurement, and evaluated whether the $L1_0$ type order structure is established.

Here, regarding the power samples of the FeNi disordered alloy in the embodiment examples and the comparison examples shown in FIG. 3, the composition ratio is an atomic stoichiometric ratio of Fe and Ni, and the particle diameter is shown as a volume average diameter (having a unit of nanometer). Further, the nitrification process conditions and the de-nitrification process conditions are the process temperature (having a unit of ° C.) and the process time (having a unit of hour).

Figure 4:
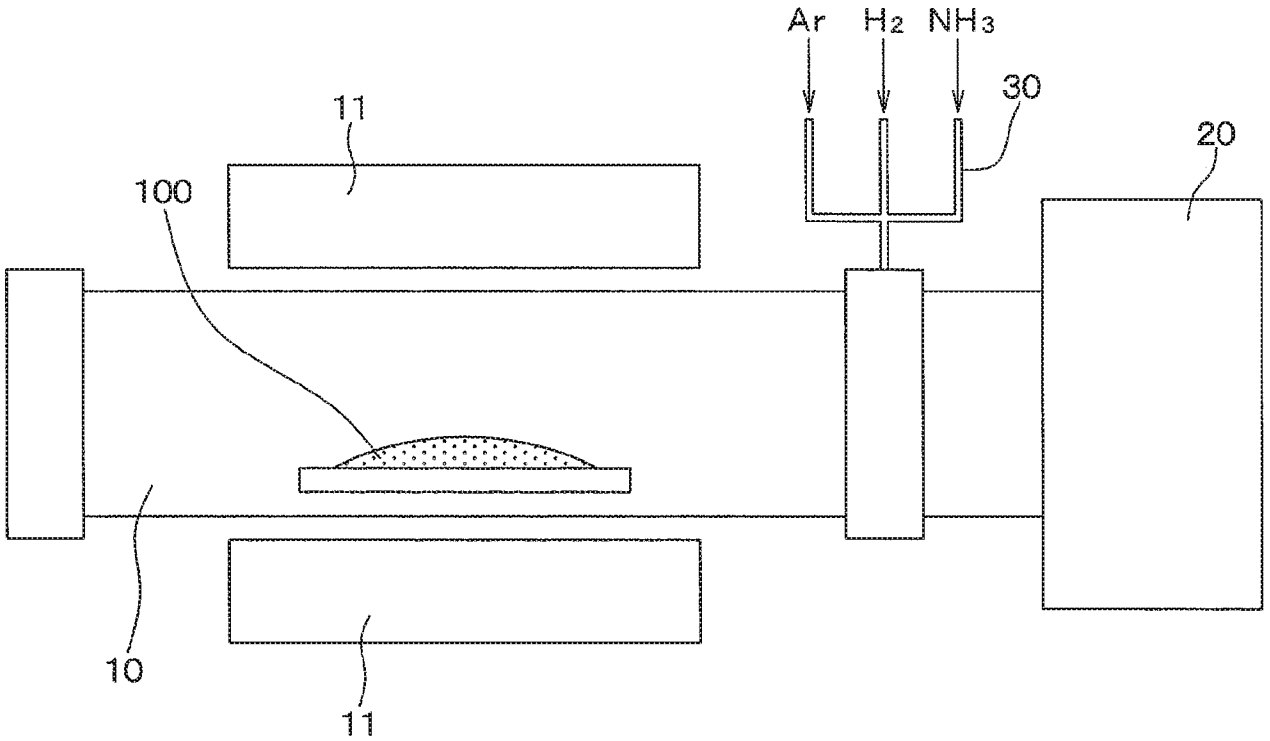
FIG. 4 is a schematic diagram showing a constitution of a manufacturing device for manufacturing the FeNi ordered alloy in the embodiment according to the first embodiment and the comparison example.

The nitrification process and the de-nitrification process are performed using a manufacturing device shown in FIG. 4, for example. The manufacturing device includes a tube furnace 10 as a heating furnace heated by a heater 11 and a globe box 20 for arranging a sample in the tube furnace 10.

Further, as shown in FIG. 4, the manufacturing device includes a gas introduction unit 30 for introducing Ar (i.e., argon) gas as a purge gas, $NH_3$ (i.e., ammonia) gas for executing the nitrification process, and $H_2$ (i.e., hydrogen)

gas for executing the de-nitrification process, which are switched and introduced into the tube furnace 10.

The manufacturing method according to the present embodiment using the above manufacturing device is described as follows. First, the power sample 100 made of the FeNi disordered alloy is arranged in the tube furnace 10. In the nitrification process, the $NH_3$ gas is introduced into the tube furnace 10, so that the inside of the tube furnace 10 is filled with the $NH_3$ atmosphere. Then, the FeNi disordered alloy is heated at predetermined temperature for a predetermined interval so as to nitride the alloy.

Then, in the de-nitrification process, the $H_2$ gas is introduced into the heating furnace so that the inside of the tube furnace 10 is filled with the H2 atmosphere. Then, the FeNi disordered alloy, which is processed by the nitrification process, is heated at predetermined temperature for a predetermined interval so as to remove the nitrogen. Thus, the $L1_0$ type FeNi ordered alloy having the average regularity S in a whole of material equal to or larger than 0.5 is obtained.

Here, in the embodiment examples and the comparison examples shown in FIG. 3, the powder sample made of FeNi disordered alloy manufactured by the thermal plasma method is a special product of Nisshin Engineering Inc., and has a composition ratio of Fe:Ni=50:50, and a volume average diameter of 104 nanometers.

Further, the powder sample made of FeNi disordered alloy manufactured by the frame spray method is a product of Sigma-Aldrich Japan LLC having a model number of 677426-5G with a composition ratio of Fe:Ni=55:45, and a volume average diameter of 50 nanometers.

Further, the powder sample made of FeNi disordered alloy manufactured by the co-precipitation method is prepared by hydrogen reduction of FeNi oxide, and has a composition ratio of Fe:Ni=47:53, and a volume average diameter of 200 nanometers.

As shown in FIG. 3, in the comparison example S0, the FeNi disordered alloy manufactured by the thermal plasma method and having the composition ratio of Fe: Ni=50:50 and the volume average diameter of 104 nanometers is evaluated by the X ray diffraction method without performing the nitrification process and the de-nitrification process.

In the comparison example S1, the FeNi disordered alloy same as in the comparison example S0 is used, and then, the nitrification process is performed for 4 hours at 300° C. Then, the sample is evaluated by the X ray diffraction method without performing the de-nitrification process. In the comparison example S2, the FeNi disordered alloy same as in the comparison example S0 is used, and then, the de-nitrification process is performed for 4 hours at 300° C. without performing the nitrification process. Then, the sample is evaluated by the X ray diffraction method.

In the embodiment example S3, the FeNi disordered alloy same as in the comparison example S0 is used, and then, the nitrification process is performed for 4 hours at 300° C. Further, the de-nitrification process is performed for 4 hours at 300° C. Then, the sample is evaluated by the X ray diffraction method. In the embodiment example S4, the FeNi disordered alloy manufactured by the frame spray method is used, and then, the nitrification process and the de-nitrification process similar to the embodiment example S3 are performed. Then, the sample is evaluated by the X ray diffraction method.

In the embodiment example S5, the FeNi disordered alloy manufactured by the co-precipitation method is used, and then, the nitrification process and the de-nitrification process similar to the embodiment example S3 are performed. Then, the sample is evaluated by the X ray diffraction method.

The embodiment examples S6, S7, S8, and S9 are conducted similar to the embodiment example S3 other than a condition such that the process temperature of the nitrification process is changed to 325° C., 350° C., 400° C. and 500° C., respectively. Further, the comparison examples S10 and S11, the embodiment examples S12, S13 and S14, and the comparison examples S15 and S16 are conducted similar to the embodiment example S3 other than a condition such that the process temperature of the de-nitrification process is changed to 150° C., 200° C., 250° C., 350° C., 400° C., 450° C. and 500° C., respectively.

Figure 5:
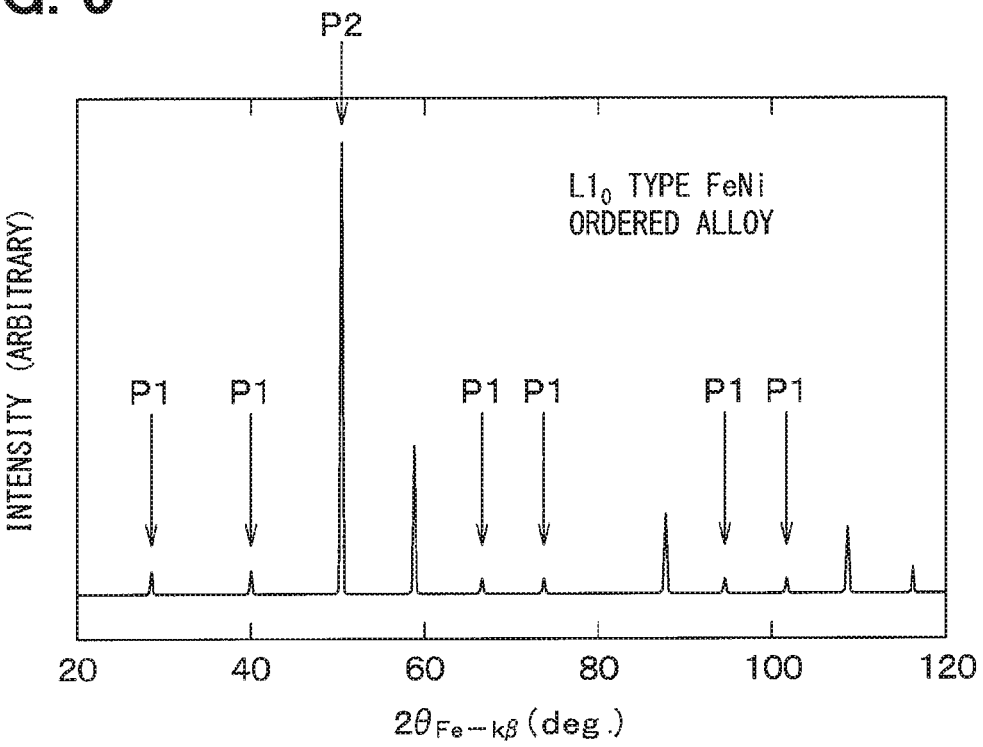
FIG. 5 is a diagram showing simulation results of a X ray diffraction pattern of $L1_0$ type FeNi ordered alloy having the regularity S of 1.

The evaluation by the X ray diffraction method whether the $L1_0$ type order structure is formed is performed by comparing with the X ray diffraction pattern of an ideal FeNi ordered alloy having the regularity S of 1 shown in FIG. 5. As shown in FIG. 5, the $L1_0$ type FeNi ordered alloy has a peak defined by a super lattice diffraction P1 disposed at a position shown by an arrow, in addition to a peak defined by a fundamental diffraction P2.

Figure 6:
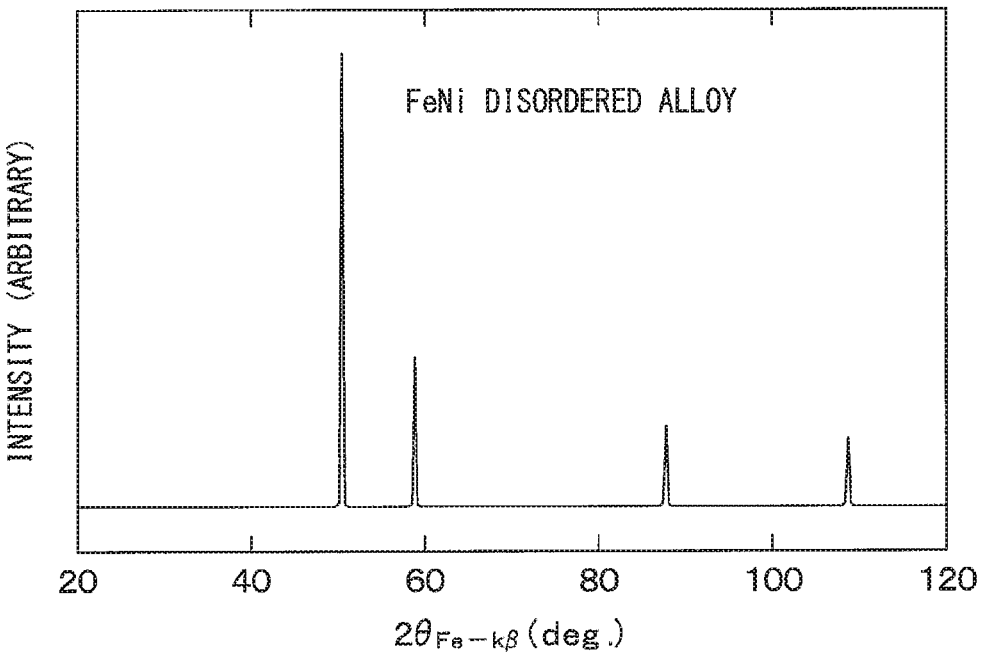
FIG. 6 is a diagram showing simulation results of a X ray diffraction pattern of FeNi disordered alloy.

On the other hand, as shown in FIG. 6, in the FeNi disordered alloy, although the fundamental diffraction P2 appears, the super lattice diffraction P1 does not appear. Here, in FIGS. 5 and 6, the X ray is a k β line of Fe with a wavelength of 1.75653 Angstrom.

Thus, in the above embodiment examples and the comparison examples, the X ray diffraction measurement is performed. When the super lattice diffraction P1 appears in the measured pattern, it is determined that the $L1_0$ type order structure is formed. When the super lattice diffraction P1 does not appear in the measured pattern, it is determined that the $L1_0$ type order structure is not formed. Here, the determination is performed whether the peaks at 28° and 40°, which is easily recognizable in the super lattice diffraction P2, clearly appear.

Thus, in FIG. 3, when the $L1_0$ type order structure is formed, an item shows "YES," and when the $L1_0$ type order structure is not formed, an item shows "NO." As shown in FIG. 3, the item "YES" is labeled to the embodiment examples S3-S9, S12-S14 and the comparison example S11. The item "NO" is labeled to the comparison examples S0-S2, S10, S15 and S16 other than S11.

In the above embodiment examples and the comparison examples, the regularity S of a sample, in which the $L1_0$ type order structure is formed, is estimated according to a method described in the above Patent Literature 1. The estimation of the regularity S is performed using an estimation equation of the regularity S in the $L1_0$ type FeNi ordered alloy shown in the following equation 1.

$$S = \sqrt{\frac{(I_{sup}/I_{fund})^{obs}}{(I_{sup}/I_{fund})^{cal}}} \quad \text{(Equation 1)}$$

Here, in the equation 1, "$I_{sup}$" indicates an integral intensity of a peak in the super lattice diffraction P1. "$I_{fund}$" indicates an integral intensity of a peak in the fundamental diffraction P2. "$(I_{sup}/I_{dunf})^{obs}$" indicates a ratio between the integral intensity of the super lattice diffraction P1 and the integral intensity of the fundamental diffraction P2 in the X ray diffraction pattern measured in each embodiment and each comparison example. Further, "$(I_{sup}/I_{fund})^{cal}$" indicates a ratio between the integral intensity of the super lattice diffraction P1 and the integral intensity of the fundamental diffraction P2 in the X ray diffraction pattern shown in FIG. 6.

As shown in the equation 1, the regularity S is obtained by calculating a square root of a division of two ratios. Here, in the comparison example S11, the formation of the $L1_0$) type order structure is shown as "YES." According to the estimation equation, the regularity S is about 0.25, which is comparatively low. Thus, since the regularity S in the present embodiment is equal to or higher than 0.5, the example S11 is defined as the comparison example.

Figure 7:
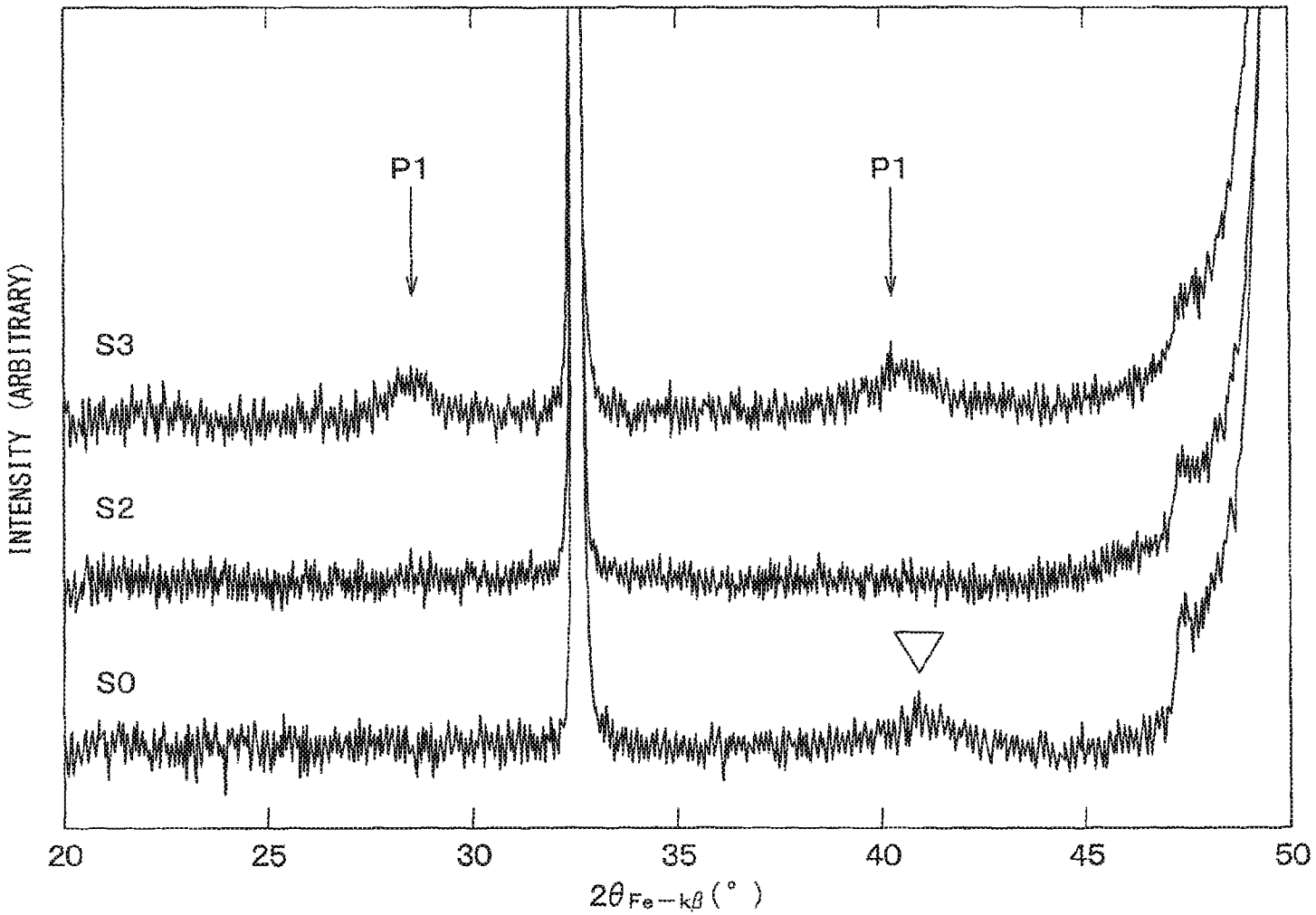
FIG. 7 is a diagram showing measurement results of a X ray diffraction pattern of FeNi ordered alloy according to comparison examples S0 and S2 and the embodiment example S3.
Figure 8:
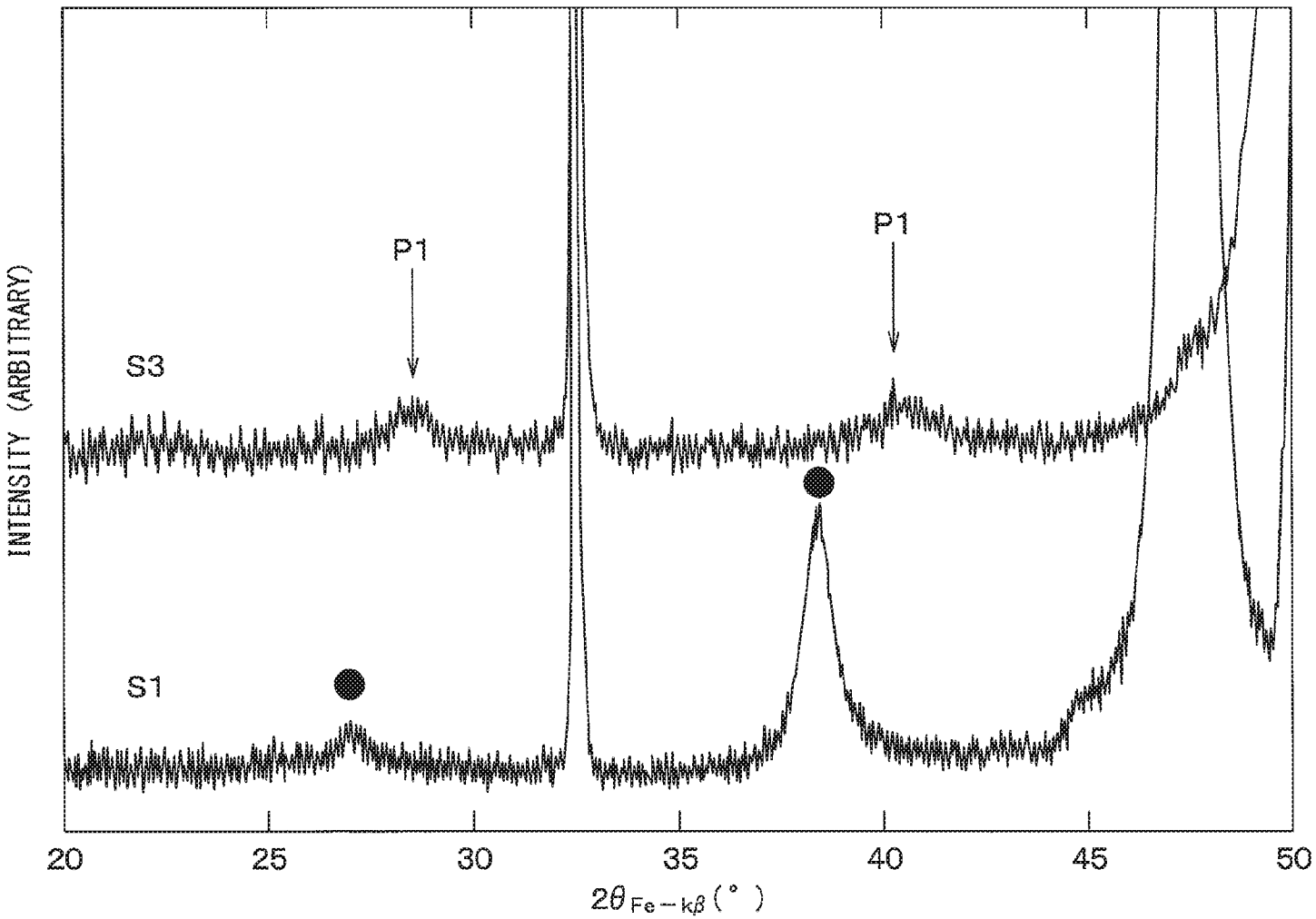
FIG. 8 is a diagram showing measurement results of a X ray diffraction pattern of FeNi ordered alloy according to a comparison example S1 and the embodiment example S3.
Figure 9:
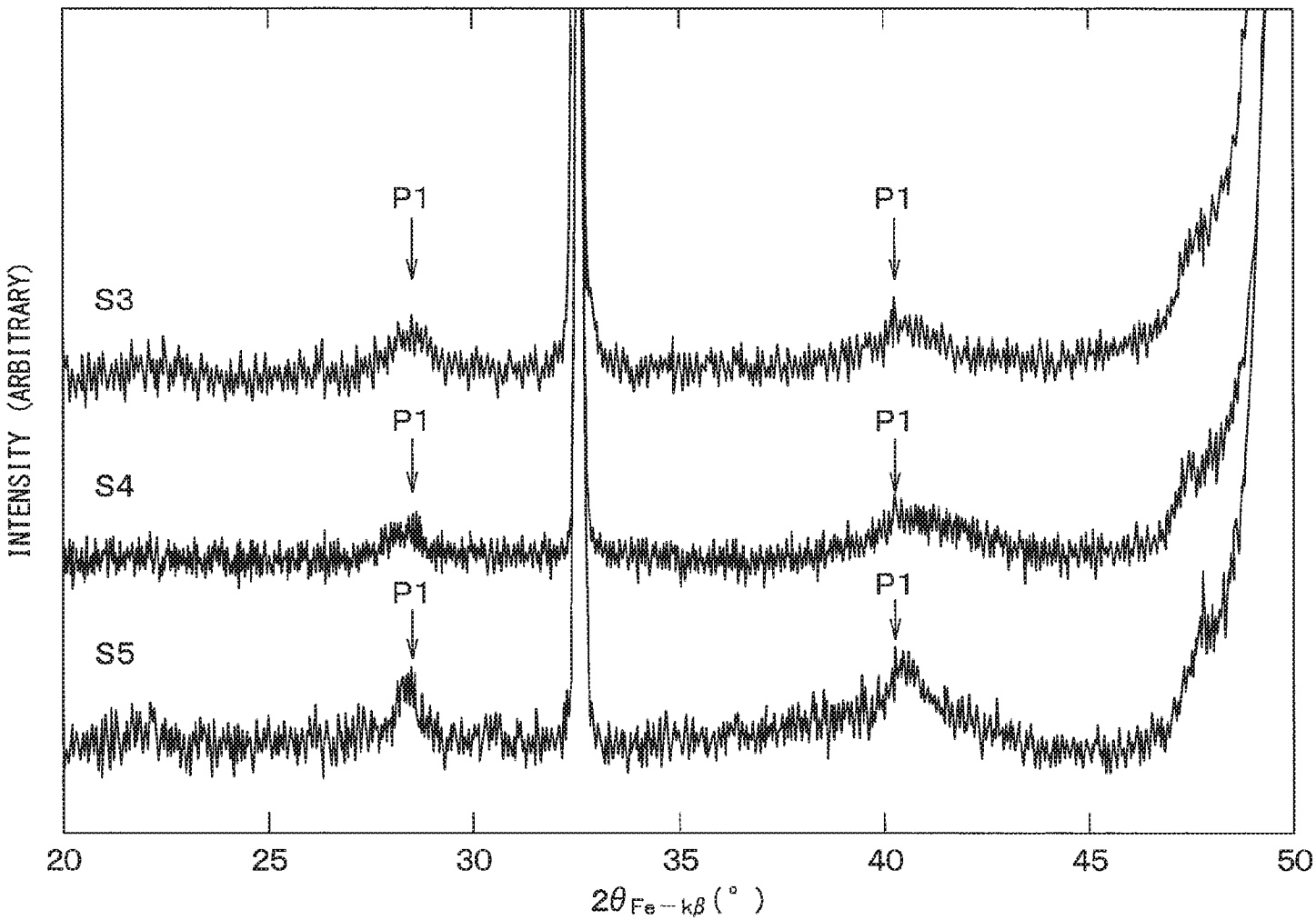
FIG. 9 is a diagram showing measurement results of a X ray diffraction pattern of FeNi ordered alloy according to the embodiment examples S3, S4 and S5.

In each of the embodiment examples and the comparison examples, a part of a typical sample of the measured X ray diffraction pattern is shown in FIGS. 7, 8 and 9. The explanation of these drawings will be described.

In FIG. 7, in the embodiment example S3, the peaks of the super lattice diffraction P2 at 28° and 40° are clearly appeared. In the comparison examples S0 and S2, the super lattice diffraction P2 is not appeared. Here, in FIG. 7, a peak symbolized by an inverted triangle in the comparison example S0 shows oxide FeNi, and therefore, the peak is not the super lattice diffraction P2. Thus, by performing both the nitrification process and the de-nitrification process, the $L1_0$) type FeNi ordered alloy is obtained.

In FIG. 8, in the embodiment example S3, the peaks of the super lattice diffraction P2 at 28° and 40° are clearly appeared. In the comparison example S1, the super lattice diffraction P2 is not appeared. Here, in FIG. 8, a peak symbolized by a black circle in the comparison example S1 is appeared at a position different from the super lattice diffraction P2. The peak shows FeNi nitride, and therefore, the peak is not the super lattice diffraction P2. In the comparison example S1, although the nitrification process is performed, the de-nitrification process is not performed. Accordingly, the example S1 is FeNi nitride.

In FIG. 9, the embodiment examples S3, S4 and S5 provide samples having different volume average diameters and made from powder samples of FeNi disordered alloy with different manufacturing methods, respectively. In each sample, the peaks of the super lattice diffraction P2 at 28° and 40° are appeared. Here, the difference of the volume average diameters is easily confirmed by an observation of an electron microscope. Thus, the $L1_0$ type FeNi ordered alloy is manufactured by performing both the nitrification process and the de-nitrification process even when the samples have different grain diameters and different manufacturing methods.

Figure 10:
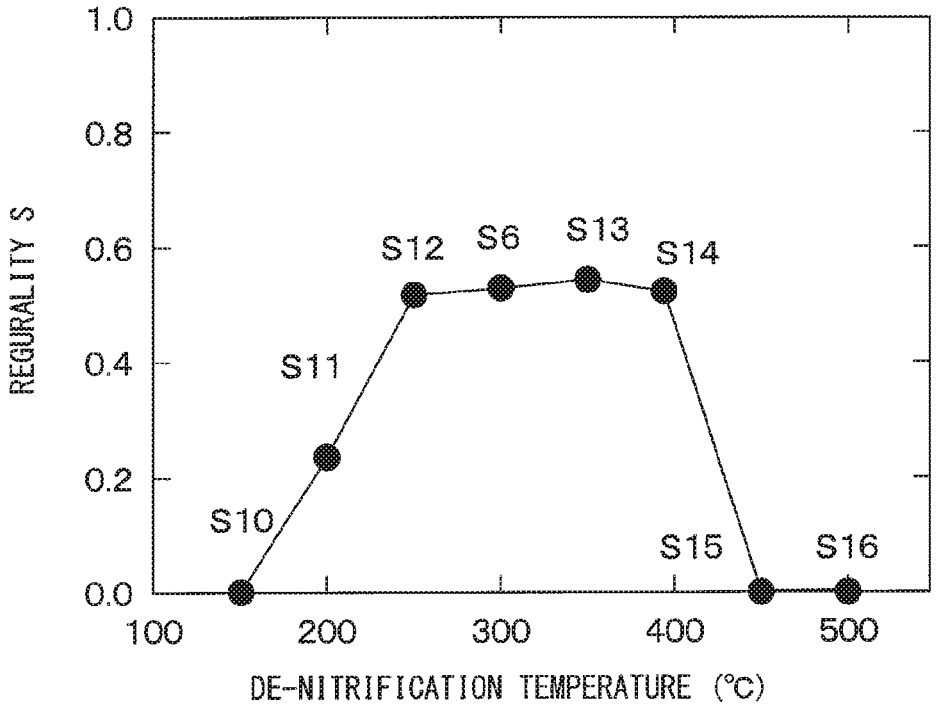
FIG. 10 is a graph showing a relationship between the regularity S and the process temperature of de-nitrification process for the FeNi ordered alloy according to the above embodiment examples and the comparison examples.

Further, with reference to FIG. 10, the relationship between the regularity S and the process temperature in the de-nitrification process about the FeNi ordered alloy will be explained in the above embodiment examples and the comparison examples. FIG. 10 shows the relationship in the embodiment examples S6 and S12 to S14 and the comparison examples S10, S11, S15 and S16 in which the same sample is used with performing the nitrification process at different process temperatures of the de-nitrification process.

As shown in FIG. 10, in the embodiment examples S12, S6, S13 and S14, in which the process temperature of the de-nitrification process is equal to or higher than 250° C. and equal to or lower than 400° C., the regularity S is equal to or higher than 0.5. However, in the comparison examples S10 and S11, in which the process temperature is lower than 250° C., the regularity S is lower than 0.5. Further, in the comparison examples S15 and S16, in which the process temperature is higher than 450° C., the super lattice is decomposed because the process temperature is too high.

Here, as described in the above embodiment examples and the above comparison examples, after the FeNi disordered alloy is processed by the nitrification process, the de-nitrification process for removing the nitrogen is performed, so that the $L1_0$ type FeNi ordered alloy having the regularity S equal to or higher than 0.5 is obtained.

The above method is a simple method with regard to a manufacturing apparatus and steps, compared with a conventional stacking method using a molecular beam epitaxy and a conventional thermal processing method with a neutron beam irradiation. Thus, in the present embodiment, the $L1_0$ type FeNi ordered alloy having the high regularity S equal to or higher than 0.5 is easily synthesized.

The $L1_0$ type FeNi ordered alloy having the high regularity S equal to or higher than 0.5 has the high regularity S which is not conventional. The magnetic material made of this alloy has excellent magnetic properties which are not obtained by a conventional magnetic material made of a conventional $L1_0$ type FeNi ordered alloy.

Further, when the composition of Fe is around 50 atomic %, the $L1_0$ type FeNi is easily formed. In the present embodiment, as described in the above embodiment examples and the above comparison examples, the high regularity with the regularity S equal to or higher than 0.5 is obtained when the alloy has the composition range of Fe between 55 atomic % and 47 atomic %.

Further, it is preferable to prepare a power sample of the FeNi disordered alloy as described above in order to shorten the nitrification process and the de-nitrification process although the configuration of the sample is not specified. Specifically, it is preferable to prepare a nano-particle sample of the FeNi disordered alloy in order to perform these processes rapidly.

Further, in the present embodiment, as described above, the regularity is confirmed even when the manufacturing methods of the powder of the FeNi disordered alloy are different. Furthermore, the manufacturing methods of the disordered alloy are not limited to the above described thermal plasma method, the frame spray method and the co-precipitation method.

Further, when the $L1_0$ type FeNi ordered alloy is formed, the nitrogen concentration in the nitride which is processed by the nitrification process is preferably in a range between 20 atomic % and 33 atomic % as an atomic weight ratio with respect to a total amount of Fe, Ni and nitrogen.

Although not limited to the nitrification process and the de-nitrification process, in the present embodiment, as described above, the $L1_0$ type FeNi ordered alloy is obtained by performing nitrification using ammonia gas and performing de-nitrification using hydrogen gas without contaminating an impurity.

Further, as described in the above embodiment examples and the above comparison examples, when the nitrification process is performed using the ammonia gas, the process temperature is preferably equal to or higher than 300° C. and equal to or lower than 500° C. In each example shown in FIG. 3, the process temperatures in the nitrification process are 300° C., 325° C., 350° C., 400° C., and 500° C., respectively. Alternatively, the process temperature of the nitrification process may not be limited to these examples.

Further, as described above in FIG. 10, when the de-nitrification process is performed using the hydrogen gas, it is preferable to set the process temperature in a range between 250° C. and 400° C. in order to increase the regularity S equal to or higher than 0.5. As shown in FIG. 10, for example, in the embodiment example S13, the regularity S of 0.53 is obtained.

Second Embodiment

A second embodiment will be explained. In the present embodiment, the regularity S is increased compared with the first embodiment. In the present embodiment, fundamental manufacturing steps are similar to the first embodiment. Thus, different features from the first embodiment will be explained.

In the present embodiment, when the $L1_0$ type FeNi ordered alloy is formed from the FeNi disordered alloy, the regularity S is further increased by producing an intermediate product. In the first embodiment, the nitrification process and the de-nitrification are performed. In eth present embodiment, after terminating the nitrification process, FeNiN is produced as the intermediate product. At this time, a process for removing an oxide film, which is formed on a surface of the FeNi disordered alloy, is performed before the nitrification process in order to produce the intermediate product appropriately in the nitrification process. When the de-nitrification process is performed based on FeNiN as the intermediate product, the $L1_0$ type FeNi ordered alloy is formed.

Figure 11:
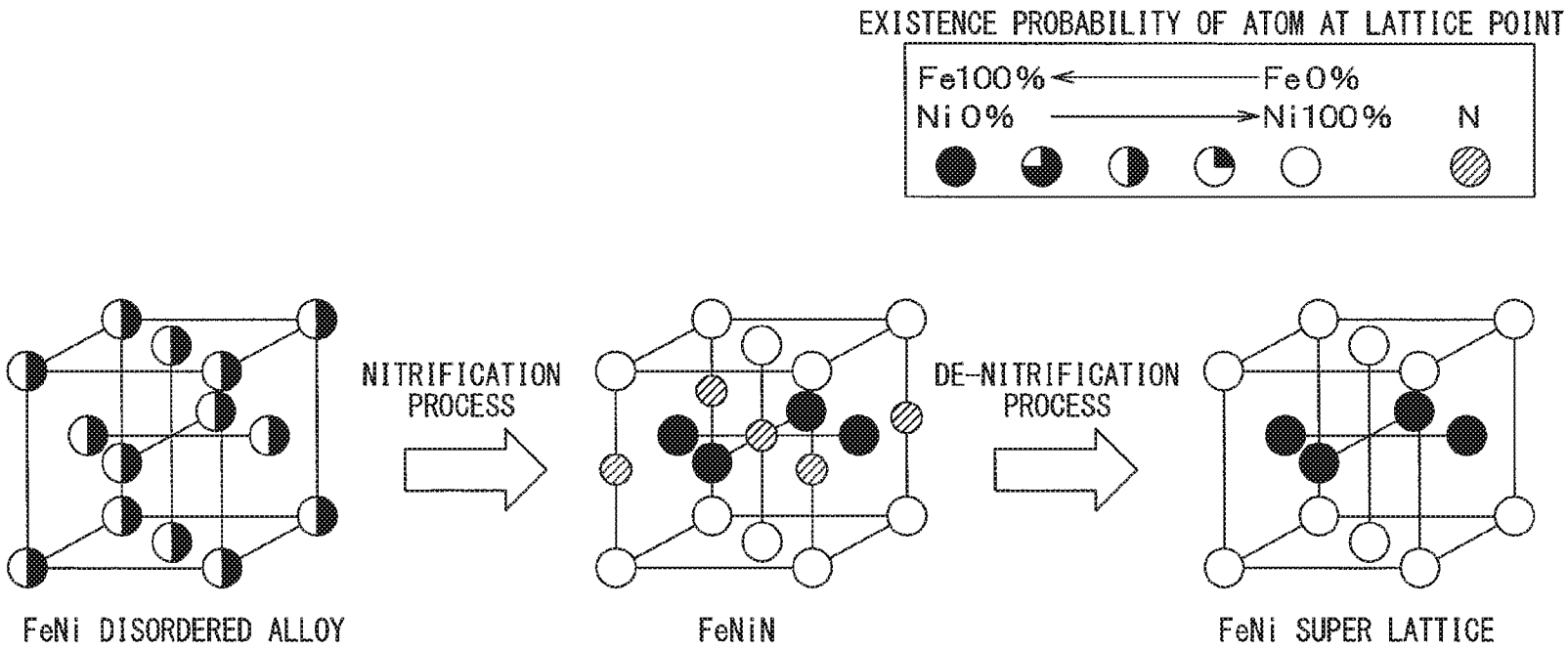
FIG. 11 is a schematic diagram showing appearance of the lattice structure when the de-nitrification process is performed after an intermediate product is synthesized by executing the nitrification process of the FeNi disordered alloy.

Specifically, as shown in FIG. 11, by performing the nitrification process of the FeNi disordered alloy, FeNiN as the intermediate product is formed such that the nitrogen is introduced into the site II shown in FIG. 1 so that the site II includes much nickel. Then, by performing the de-nitrification process, the nitrogen is discharged from the site II, so that the $L1_0$ type FeNi ordered alloy is formed.

First, the FeNi disordered alloy is prepared. Then, since the oxide film is formed on the surface of the FeNi disordered alloy, the removal process for removing the oxide film on the surface of the FeNi disordered alloy is performed prior to the nitrification process. Then, the nitrification process is performed successively from the removal process.

In the removal process, the thermal process is performed at, for example, temperature in a range between 300° C. and 450° C. in an etching atmosphere of the oxide film. Thus, the oxide film on the surface of the FeNi disordered alloy is removed, so that, under the surface condition, the sample is easily nitrided. In the nitrification process, the thermal process is performed at, for example, temperature in a range between 200° C. and 400° C. in atmosphere including nitrogen. Thus, the FeNi disordered alloy, which is easily nitrided by removing the oxide film, is easily nitrided appropriately, so that FeNiN as the intermediate product is formed.

Next, the de-nitrification process is performed in FeNiN as the intermediate product. In the de-nitrification process, the thermal process is performed at, for example, temperature in a range between 200° C. and 400° C. in de-nitrification atmosphere. Thus, the nitrogen is removed from the intermediate product so that the $L1_0$ type FeNi ordered alloy is formed. Thus, after FeNiN as the intermediate product is formed, the $L1_0$ type FeNi ordered alloy is formed so that the higher regularity S is obtained.

A concrete example will be explained such that, actually, the above described removal process, the nitrification process and the de-nitrification process are performed, and the $L1_0$ type FeNi ordered alloy is formed.

Figure 12A:
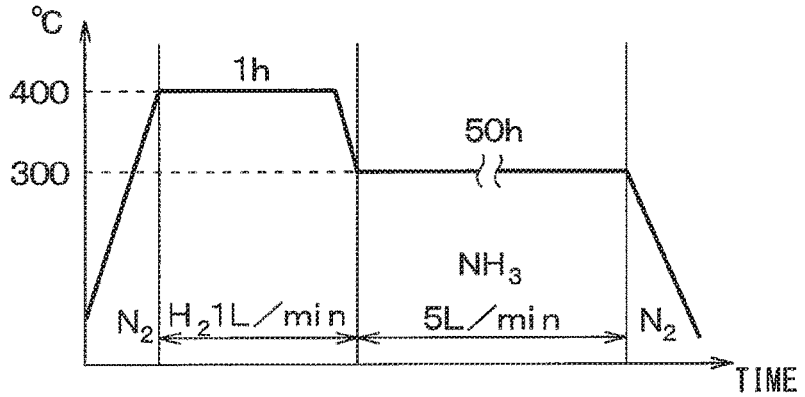
FIG. 12A is a time chart showing a profile of a removing process of an oxide film and a nitrification process.

First, the removal process and the nitrification process are performed according to a profile shown in FIG. 12A.

Specifically, a heating furnace such as the above described tube furnace 10 or a muffle furnace is prepared. The nano-particle sample made of the FeNi disordered alloy having the average diameter of 30 nanometers is arranged in the heating furnace. Then, the temperature of the heating furnace is increased from room temperature to the temperature in the removal process for removing the oxide film, 400° C. in this case. At this moment, an inert gas is introduced into the furnace in order to restrict the nano-particle sample from being oxidized by oxygen disposed in the heating furnace. In this case, $N_2$ (nitrogen) is introduced, and temperature rising step is performed.

Here, $N_2$ is used as the inert gas since $N_2$ is also utilized in the nitrification process. Alternatively, other inert gas other than $N_2$ such as Ar (argon) and He (helium) may be used.

After the temperature of the heating furnace is increased to the temperature of the removal process, the introduction of $N_2$ is stopped, and the etching gas of the oxide film is introduced so that the etching atmosphere is created. Then, the temperature of the heating furnace is maintained for a predetermined period to be temperature which is necessary to remove the oxide film. In this experiment, the etching gas is H2 (hydrogen). H2 is introduced into the heating furnace at a rate of 1 L/min, and the heating furnace is maintained at 400° C. for one hour. Thus, the oxide film on the surface of the nano-particle sample is removed.

The process time necessary to remove the oxide film may be any. For example, when the process is performed for 10 minutes or longer, it is confirmed that the oxide film is removed to some extent. Further, temperature for removing the oxide film may be at least in a range between 300° C. and 450° C.

The lower limit of the temperature for removing the oxide film is set to be 300° C. since it is confirmed that the oxide film is removed at temperature of at least 300° C. or higher. Here, even when the temperature is lower than 300° C., it is considered that the oxide film may be removed as long as it takes much time. The upper limit of the temperature for removing the oxide film is determined so as to perform the nitrification of the FeNi disordered alloy easily after that. Specifically, when the temperature for removing the oxide film is increased to be higher than 450° C., the surface of the FeNi disordered alloy on which the oxide film is removed is sintered so that the nitrification is difficult. Accordingly, in order to restrict the surface of the FeNi disordered alloy from being sintered, the temperature is set to be equal to or lower than 450° C. Further, the introducing rate of the etching gas into the heating furnace may be any. For example, when $H_2$ is used, the oxide film is removed in at least a range between 0.3 L/min and 5 L/min.

Thus, after completing the removal process of the oxide film, the nitrification process is successively performed in the same heating furnace. Specifically, the introducing gas into the heating furnace is switched from the etching gas to the nitrification gas so that the inside of the heating furnace is in atmosphere including nitrogen. Then, the temperature necessary to nitrification is maintained. In the present experiment, $NH_3$ (ammonia) is used as the nitrification gas. $NH_3$ is introduced into the heating furnace at an introducing rate of 5 L/min. The heating furnace is maintained at 300° C. for 50 hours. Thus, the nano-particle sample is nitrided, and FeNiN is produced as the intermediate product.

The time necessary for the nitrification process may be any. For example, when the process is performed for 10 hours, it is confirmed that FeNiN is produced as the intermediate product. Further, the temperature of the nitrification process may be in a range between 200° C. and 400° C. The introducing rate of the nitrification gas into the heating furnace in order to generate the atmosphere including nitrogen may be any. For example, when NH3 is used, the nano-particle sample is nitrided in at least a range between 0.1 L/min and 10 L/min.

Thus, the nitrification process is performed successively after the removal process of the oxide film. In this case, the oxide film is restricted from being formed on the surface of the FeNi disordered alloy again, on which the oxide film is removed. Further, the temperature increasing step is not necessary again. Thus, the thermal process is simplified, and the process time is shortened.

Figure 12B:
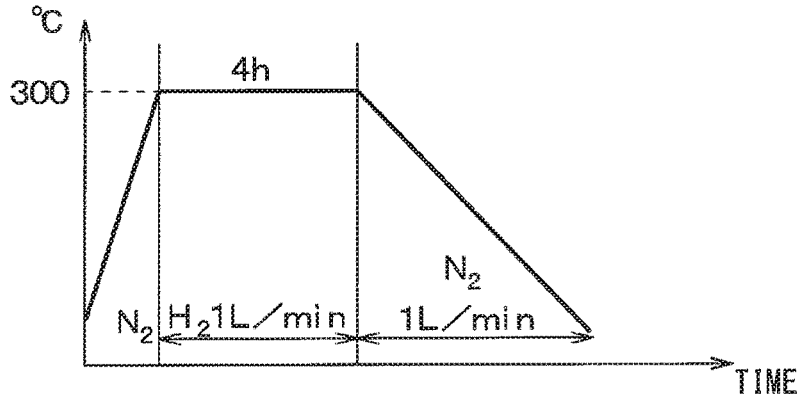
FIG. 12B is a time chart showing a profile of a de-nitrification process.

Then, the de-nitrification process is performed. The de-nitrification process is executed according to a profile shown in FIG. 12B. Here, the de-nitrification process is performed after certain time has elapsed from the nitrification process. Alternatively, the de-nitrification process may be performed successively after the nitrification process.

First, a heating furnace such as the above described tube furnace 10 or a muffle furnace is prepared. FeNiN is arranged in the heating furnace as the intermediate product produced according to the profile shown in FIG. 12A. Then, the temperature of the heating furnace is increased from room temperature to temperature at the de-nitrification process, i.e., 300° C. In this case, an inert gas is introduced into the furnace in order to restrict FeNiN as the intermediate product from being oxidized by oxygen disposed in the heating furnace. In this case, $N_2$ is introduced, and temperature rising step is performed.

After the temperature of the heating furnace is increased to the temperature of the de-nitrification process, the introduction of $N_2$ is stopped, and the atmosphere for performing the de-nitrification process is created. The temperature of the heating furnace is maintained for a predetermined period to be temperature which is necessary for the de-nitrification. In the present experiment, $H_2$ (hydrogen) is used for producing the atmosphere for performing the de-nitrification. H2 is introduced into the heating furnace at a rate of 1 L/min. Then, the heating furnace is maintained at 300° C. for 4 hours. Thus, FeNiN as the intermediate product is de-nitrided.

The time necessary for the de-nitrification process may be any. For example, when performing for one hour or longer, it is confirmed that the $L1_0$ type FeNi ordered alloy is produced. It is confirmed that the temperature of the de-nitrification process may be in a range between 200° C. and 400° C. Further, the introducing rate of the gas into the heating furnace in order to produce the atmosphere for performing the de-nitrification process may be any. For example, when $H_2$ is used, the de-nitrification process is executed in at least a range between 0.1 L/min and 5 L/min.

Thus, by performing the de-nitrification process, the $L1_0$ type FeNi ordered alloy is produced. Then, the average regularity S of a whole material of the $L1_0$ type FeNi ordered alloy manufactured is obtained. Specifically, using the powder X ray diffraction pattern, the regularity S is obtained.

Figure 13:
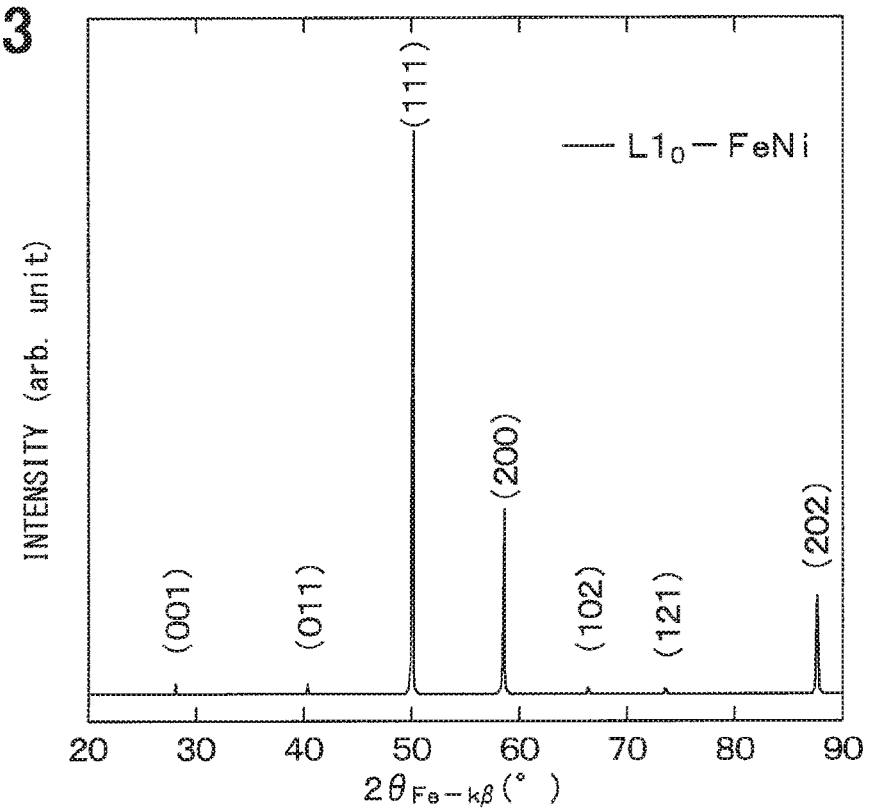
FIG. 13 is a diagram showing a X ray diffraction pattern of a powder of $L1_0$ type FeNi ordered alloy when the regularity S is 1.
Figure 14:
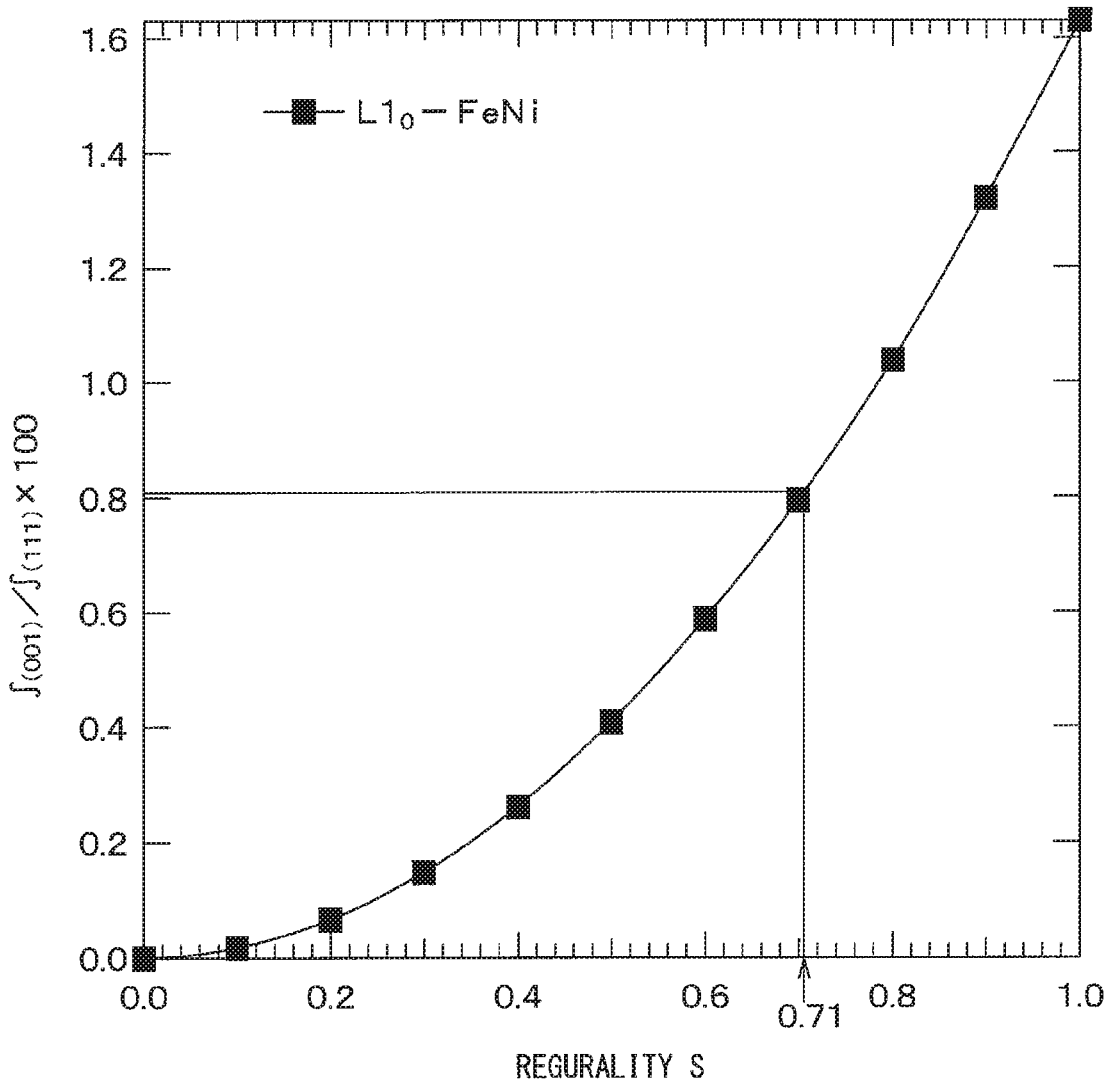
FIG. 14 is a graph showing a relationship between the regularity S and the diffraction intensity ratio.

For example, when the regularity S is 1, the powder X ray diffraction pattern of the $L1_0$ type FeNi ordered alloy is shown in FIG. 13. The regularity S has a relationship shown in FIG. 14 with respect to the diffraction strength ratio between the integral intensity of the peak of the super lattice diffraction, i.e., the diffraction peak from a (001)-plane as a super lattice reflection and the integral intensity of the peak of the fundamental diffraction, i.e., the diffraction peak from a (111)-plane in the X ray diffraction pattern. Accordingly, the X ray diffraction pattern of the $L1_0$ type FeNi ordered alloy manufactured according to the present embodiment is measured. Based on the measurement results, the regularity S is obtained.

Figure 15:
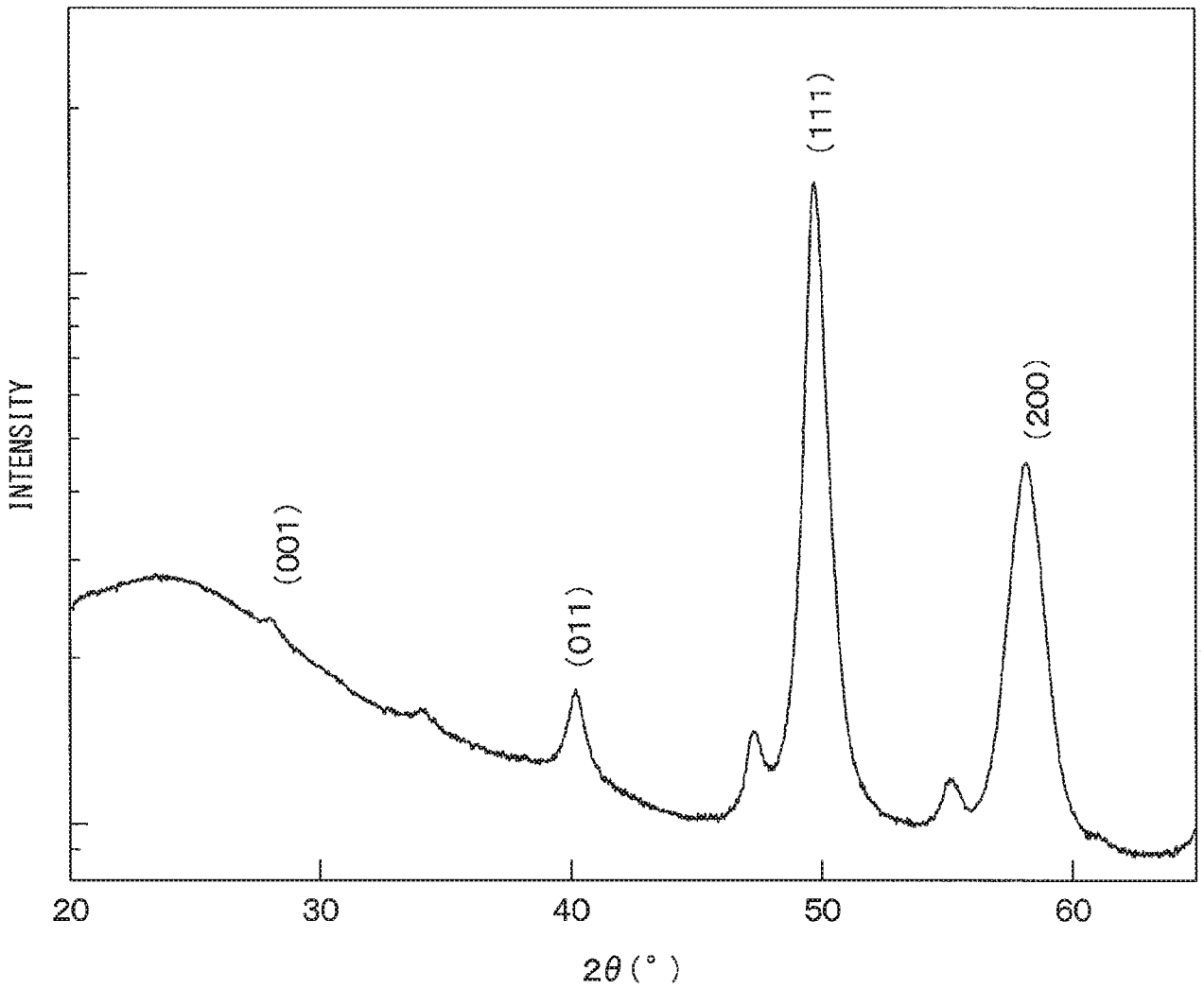
FIG. 15 is a diagram showing measurement results of a X ray diffraction pattern of $L1_0$ type FeNi ordered alloy manufactured by a manufacturing method according to a second embodiment.

Specifically, in the present embodiment, FeNiN is produced as the intermediate product by performing the nitrification process after the removal process of the oxide film from the FeNi disordered alloy is performed. Then, the de-nitrification process is performed, so that the $L1_0$ type FeNi ordered alloy is formed. Then, the X ray diffraction pattern is obtained. FIG. 15 shows a result of the X ray diffraction.

As shown in FIG. 15, since the peak of the super lattice diffraction from the (001)-plane is appeared, it is determined that the FeNi super lattice is formed. Based on the results, the diffraction strength ratio is calculated, so that the diffraction strength ratio is 0.8. When the diffraction strength ratio is 0.8, the regularity S is calculated based on FIG. 14. The regularity S is 0.71, which is comparatively high value.

Thus, the L1 type FeNi ordered alloy having the high regularity S and manufactured by the manufacturing method according to the present embodiment is obtained. Further, the magnetic property evaluation of the $L1_0$ type FeNi ordered alloy is performed, so that the anisotropic magnetic field is 981 kA/m, which is comparatively high value.

As described above, in the present embodiment, FeNiN as the intermediate product is produced by performing the nitrification process of the FeNi disordered alloy. Further, the de-nitrification process is performed, so that the $L1_0$ type FeNi ordered alloy is produced. According to the manufacturing method, the $L1_0$ type FeNi ordered alloy having the high regularity S equal to or higher than 0.7 is easily manufactured.

Specifically, when the nitrification process is performed after the removal process for removing the oxide film formed on the surface of the FeNi disordered alloy is performed, the intermediate product is produced appropriately. Accordingly, by performing the removal process, the $L1_0$ type FeNi ordered alloy having the much higher regularity S is obtained.

Other Embodiments

The present disclosure is not limited to the above described embodiments.

For example, an example of conditions for the nitrification process and the de-nitrification process is explained in the first embodiment. However, that explanation is merely one example of each condition. As long as the $L1_0$ type FeNi ordered alloy having the regularity S equal to or higher than 0.5 is obtained by performing the nitrification process and the de-nitrification process, the process temperature of each process and the process time of each process may not be limited to the above example. Similarly, in the second embodiment, an example of conditions for the removal process of the oxide film, the nitrification process and the de-nitrification process is explained. However, that explanation is merely one example of each condition. As long as the $L1_0$ type FeNi ordered alloy having the regularity S equal to or higher than 0.7 is obtained, the process temperature of each process and the process time of each process may not be limited to the above example.

In the first embodiment and the second embodiment, the $L1_0$ type FeNi ordered alloy is obtained by performing the nitrification process and the de-nitrification process. Alternatively, the $L1_0$ type FeNi ordered alloy may be obtained by performing a process other than the nitrification process and the de-nitrification process. For example, after a process for synthesizing a compound in which Fe and Ni are aligned with the same lattice structure as the $L1_0$ type FeNi order structure is performed, the $L1_0$ type FeNi ordered alloy may be obtained by performing a process for removing an element, which is an unnecessary element other than Fe and Ni, from the compound.

Further, the $L1_0$ type FeNi ordered alloy according to the above embodiments may be applied to the magnetic material such as the magnet material, the magnetic storage material or the like. The aspect of the FeNi ordered alloy is not limited to the magnetic material.

The present disclosure is not limited to the above described embodiments. The contents of the description in the above embodiments are not totally unrelated to each other, but they appropriately combine with each other except for a case where they cannot clearly combine with each other.

Furthermore, the above embodiments are not limited to the above embodiment examples.

The invention claimed is:

1. A method for manufacturing FeNi ordered alloy having an $L1_0$ order crystal structure, the method for manufacturing the FeNi ordered alloy comprising:

performing a nitrification process for nitriding FeNi disordered alloy; and then, performing a de-nitrification process for removing a nitrogen from the FeNi disordered alloy, which is processed in the nitrification process, to obtain FeNi ordered alloy with an $Ll_0$ crystal structure and a regularity defined by S equal to, or higher than, 0.5.

2. The method for manufacturing the FeNi ordered alloy according to claim 1, wherein:

a process temperature of the nitrification process is equal to or higher than, 300° C. and equal to or lower than, 500° C.

3. The method for manufacturing the FeNi ordered alloy according to claim 1, wherein:

a process temperature of the de-nitrification process is equal to, or higher than 250° C. and equal to, or lower than 400° C.

4. A method for manufacturing FeNi ordered alloy having an $Ll_0$ order crystal structure, the method for manufacturing the FeNi ordered alloy comprising:

synthesizing a compound in which Fe and Ni are aligned to have a lattice structure identical to a FeNi order structure with an $L1_0$ crystal structure; and removing an unnecessary element other than Fe and Ni from the compound to produce FeNi ordered alloy with the $L1_0$ crystal structure.

5. The method for manufacturing the FeNi ordered alloy according to claim 4, wherein:

the synthesizing of the compound includes synthesizing FeNiN as the compound.

6. The method for manufacturing the FeNi ordered alloy according to claim 5, further comprising:

removing an oxide film from FeNi disordered alloy, wherein:

the synthesizing of the compound includes performing a nitrification process of the FeNi disordered alloy in which the oxide film is removed after the removing of the oxide film to synthesize the FeNiN as an intermediate product.

7. The method for manufacturing the FeNi ordered alloy according to claim 6, wherein:

the removing of the oxide film and the synthesizing of the compound are successively performed in a same heating furnace.

* * * * *